US005740908A

United States Patent [19]

Anzalone

[11] Patent Number: 5,740,908

[45] Date of Patent: Apr. 21, 1998

[54] DEVICE FOR DISPLAYING AND PROTECTING A HAIRBRUSH

[75] Inventor: Paul A. Anzalone, Huntington, N.Y.

[73] Assignee: Goody Products, Inc., N.J.

[21] Appl. No.: 623,247

[22] Filed: Mar. 28, 1996

[51] Int. Cl.[6] ..... B65D 65/12

[52] U.S. Cl. ..... 206/362.3; 206/15.3; 206/362.4

[58] Field of Search ..... 206/361, 362.2, 206/362.3, 362.4, 15.3; 229/87.01

[56] References Cited

U.S. PATENT DOCUMENTS

| | | | |
|---|---|---|---|
| 131,855 | 10/1872 | Crandal . | |
| 224,913 | 2/1880 | Hollwede . | |
| 1,023,641 | 4/1912 | Greer | 206/362.3 |
| 1,710,598 | 4/1929 | Wasserman . | |
| 1,827,654 | 10/1931 | Harper . | |
| 1,847,512 | 3/1932 | Hanson . | |
| 1,938,442 | 12/1933 | Stuart . | |
| 2,071,232 | 2/1937 | Langehennig | 229/87.01 |
| 2,302,726 | 11/1942 | Vazoy . | |
| 2,419,745 | 4/1947 | Trecek . | |
| 2,506,821 | 5/1950 | White | 206/362.4 |
| 2,582,992 | 1/1952 | Hergert . | |
| 2,763,367 | 9/1956 | Schumann | 206/362.4 |
| 2,841,273 | 7/1958 | Scott | 206/362.4 |
| 2,944,665 | 7/1960 | Obeck . | |
| 2,956,676 | 10/1960 | Dgetluck . | |
| 2,984,401 | 5/1961 | Herkender | 206/361 X |
| 3,035,693 | 5/1962 | Ehrler . | |
| 3,331,493 | 7/1967 | Anglin . | |
| 4,032,005 | 6/1977 | Vereb . | |
| 4,039,079 | 8/1977 | Laughton . | |
| 4,207,977 | 6/1980 | Kronfeld et al. . | |
| 4,847,939 | 7/1989 | Derencsenyl et al. . | |
| 5,358,107 | 10/1994 | Laske . | |
| 5,566,820 | 10/1996 | Deaton | 206/15.3 |

*Primary Examiner*—Bryon P. Gehman
*Attorney, Agent, or Firm*—Foley & Lardner

[57] ABSTRACT

A device for displaying, and protecting from use prior to sale, a hairbrush. The device is formed from a sheet of material, with a larger rectangular portion encircling most of the bristles of the hairbrush, and a small rectangular portion having a hole therein for receiving the handle of the hairbrush.

18 Claims, 2 Drawing Sheets

FIG. 2
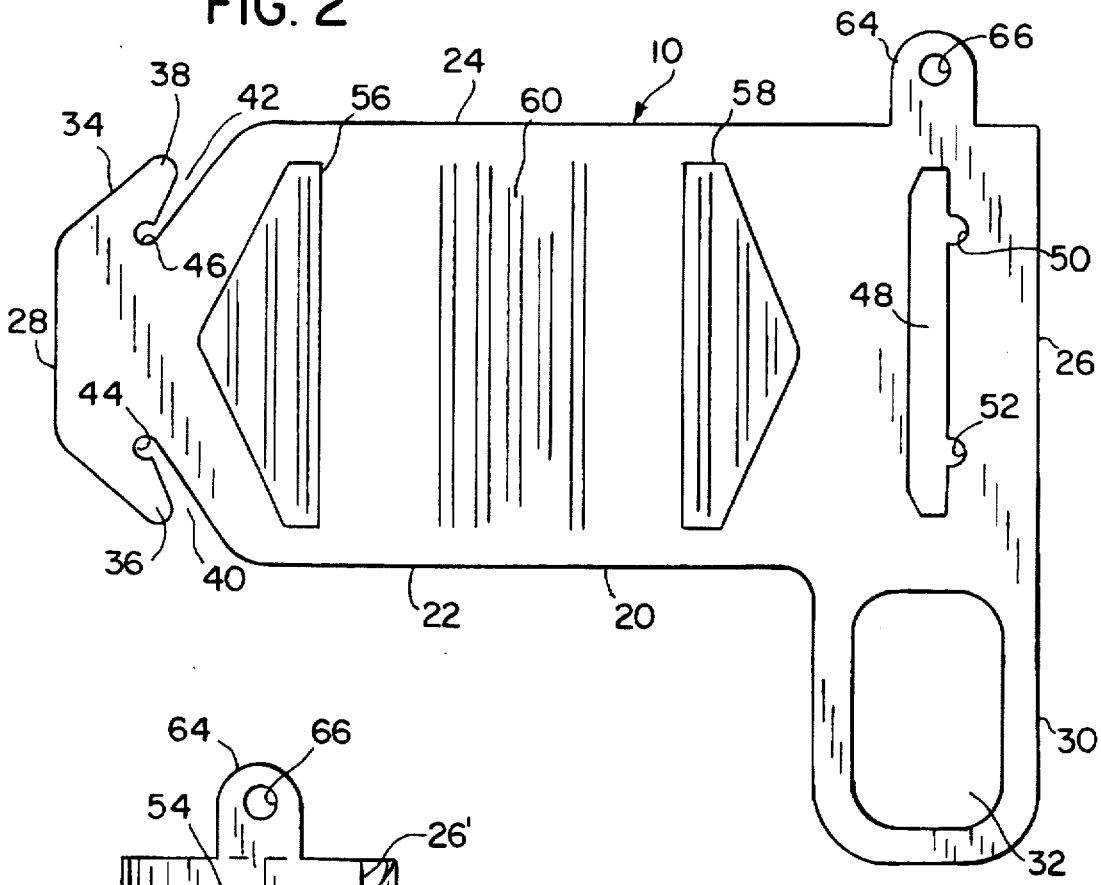
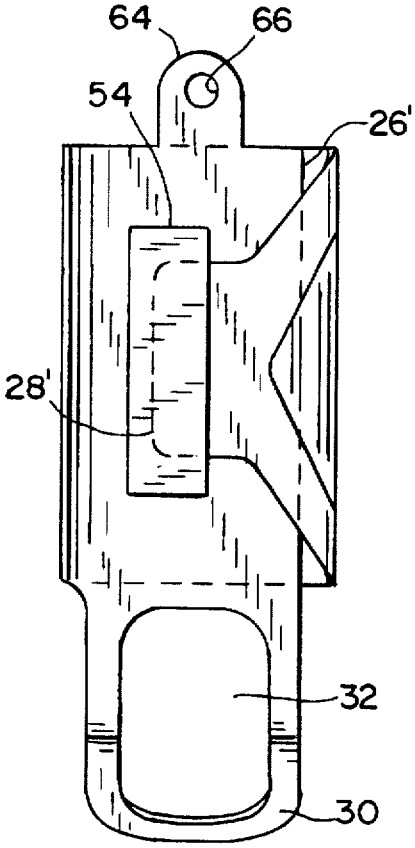
FIG. 6
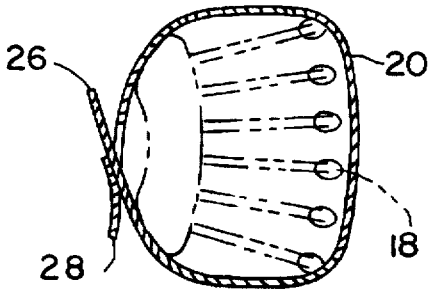
FIG. 5

DEVICE FOR DISPLAYING AND PROTECTING A HAIRBRUSH

I. FIELD OF THE INVENTION

This invention relates to a device for use in displaying for sale and protecting from use prior to sale a hairbrush having a handle and an elongated section of bristles.

II. DESCRIPTION OF RELATED ART INCLUDING INFORMATION DISCLOSED UNDER SECTION 1.97–1.99

In displaying personal care products such as hairbrushes for retail sale, it is desirable that the packaging discourage the use of the product prior to sale yet reveal enough of the product to encourage its purchase. Further, the packaging should be relatively inexpensive and readily secured on the product.

Various types of display devices for brushes have been provided in the past. The following patents are illustrious of such devices:

| U. S. Pat. No. | Inventor |
|---|---|
| 1,827,654 | Harper |
| 1,938,442 | Stuart |
| 2,419,745 | Trecek |
| 2,944,665 | Obeck |
| 2,956,676 | Dgetluck |
| 3,035,693 | Ehrler |
| 4,032,005 | Vereb |
| 4,039,079 | Laughton |
| 4,207,977 | Kronfeld et al. |

The Stuart, Obeck, Dgetluck, Ehrler, and Kronfeld, et al. patents set forth display devices for paint brushes which include portions covering the brush bristles. The Stuart patent reveals a display container for paint brushes wherein a container of bag completely enclose the bristle portion of the brush and is secured to the brush by a separate sealing device. The Obeck patent reveals a paint brush display card in which a flap is formed for engaging the paint brush handle. The bristles of the brush are covered by a separate jacket. The Dgetluck patent reveals a punch board display for a paint brush in which a card blank is formed with a main panel and a tube for encircling a portion of the brush. The rectangular tube is formed by making folds in a portion of the blank and by securing a folded portion to the main panel. Tongues are formed in both the main panel and the folded portion to retain the brush on the display board.

The Ehrler patent reveals a generally rectangular backing member to which is secured a transparent plastic bubble or blister which covers the barrel and bristles of the brush. The Kronfeld et al. patent reveals an applicator brush package wherein a cardboard sheet is folded into a generally rectangular shape with the ends glued together. A tab portion folded to the inside at one of the ends serves as a stop for retaining the brush in the package. The remaining Harper, Trecek, Vereb, and Laughton patents reveal display packages or covers for brushes including toothbrushes.

SUMMARY OF THE INVENTION

It is an object of this invention to provide a device for displaying and protecting a hairbrush which may be manufactured at minimal cost and which is readily secured on a hairbrush with minimal effort. It is the further object of this invention to provide a display device for a hairbrush which prevents the use of the hairbrush by covering some of the bristles, while at the same time permitting viewing of other bristles prior to purchase of the brush. It is the still further object of the invention to provide a device for displaying and protecting a hairbrush upon which is printed information relating to the brush.

In accordance with this invention a device is provided for use in displaying for sale and protecting from use prior to sale a hairbrush having a handle and an elongated section of bristles. The device which is formed from a sheet of flexible material includes a stripe having first and second sides and first and second ends, with the sides being longer than the ends. It also includes a smaller generally rectangular tab extending from the first one of the sides of the a strip adjacent one of said ends. The tab has a hole therein for receiving the handle of a hairbrush. Securing means such as a slot and a tab to be received therein, are formed at opposite ends of the strip. The strip with the securing means engaged, is placed over a portion of the elongated section of bristles of the brush. The brush may be hung on a display rack by a hole formed in the brush handle, or a tab may be provided on the opposite side of the strip, at the same end as the first tab, with a hole therein for hanging the device and the brush secured therein on a display rack.

BRIEF DESCRIPTION OF THE DRAWINGS

FIG. 2 is a plan view of the device of this invention prior to being secured on a brush as shown in FIG. 1.

FIG. 5 is a cross-sectional view of the device shown in FIG. 1 taken along the line 5—5 in FIG. 4.

FIG. 6 is a rear elevation view, corresponding to FIG. 3, of an alternate embodiment of this invention.

DETAILED DESCRIPTION OF THE PREFERRED EMBODIMENT

Figure 1:
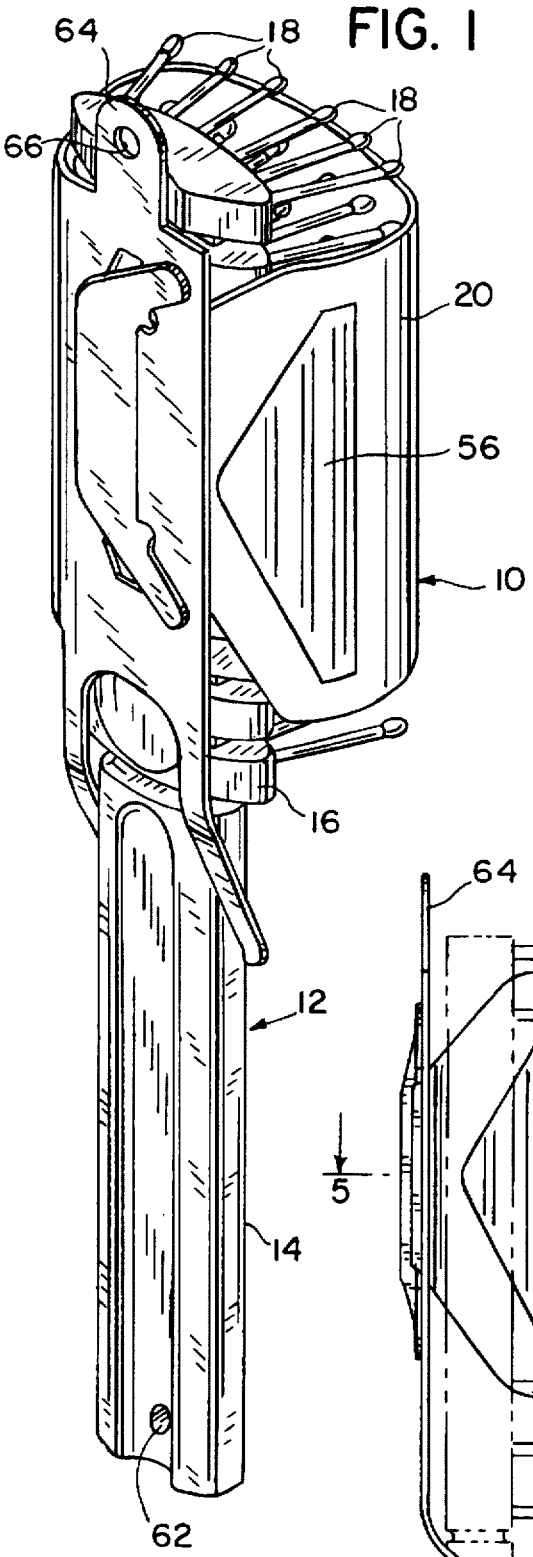
FIG. 1 is a perspective view of a device in accordance with this invention, which is secured on a brush for displaying the brush for sale and for protecting the brush from use prior to sale.

Referring to FIG. 1, a display and protection device 10 in accordance with this invention is shown secured on a hairbrush 12 which includes a handle portion 14 and an elongated section 16 provided with bristles 18.

Referring to FIG. 2, display and protection device 10 is formed from a sheet of material with a strip of a larger generally rectangular portion 20 having first and second opposite sides 22 and 24 and first and second opposite ends 26 and 28. A first tab of a smaller rectangular portion 30 extends from the side 22 adjacent the end 26 of the larger rectangular portion 20. The tab of a smaller rectangular portion 30 is formed with a hole 32 therein for receiving the handle portion 14 of the brush 12.

To secure the larger rectangular portion 20 around the bristles 18 of the brush as shown in FIG. 1, securing means are formed at the ends 26 and 28 of the larger rectangular portion 20, to secure the ends to each other. In the preferred embodiment of this invention, a portion of the securing means at the second end 28 is in the form of an arrowhead shaped tab or projection 34 which has trailing tips 36 and 38. Trailing tips 36 and 38 are separated from the main body of the rectangular portion 20 by slots 40 and 42 which terminate in generally round ends 44 and 46. The securing means at the first end 26 of the larger rectangular portion 20 is in the form of a rectangular slot 48. The outer side of rectangular slot 48, that is the side closer to the end 26, is provided with a pair of notches 50 and 52.

Figure 3:
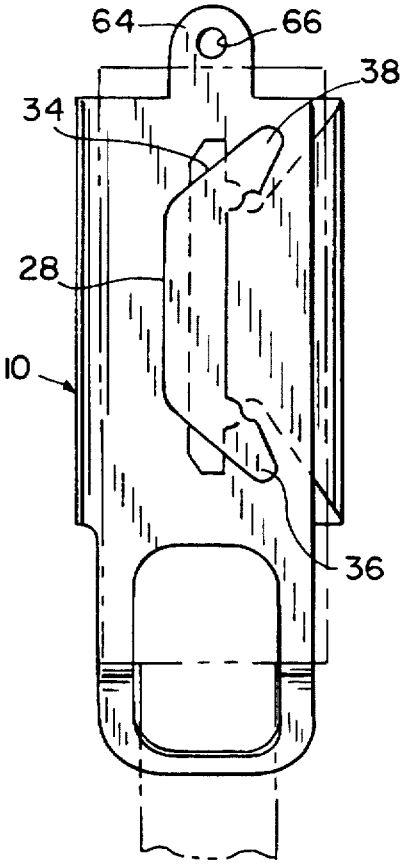
FIG. 3 is a rear plan view of the device of this invention as shown in FIG. 1.

To place the device 10 on the brush 12, as shown in FIG. 1, the arrowhead shaped tab or projection 34 is first engaged in the notch 48, with the notches 50 and 52 being engaged in the round ends 44 and 46 of the slots 40 and 42. The brush is then inserted handle first, from the top as shown in FIG. 1 through the cylindrical tube formed by the larger rectangular portion 20. With the tab 30 bent inwardly, toward the center of the circular tube, the handle 14 will pass through the hole 32 formed in the tab. The engagement of the arrowhead shaped tab or projection 34 with the rectangular slot 48 is shown in further detail in FIGS. 3, 4 and 5.

In an alternate embodiment, the ends 26' and 28' of the larger rectangular portion 20 may be secured by a piece of tape 54 as shown in FIG. 6. As indicated by the symbols 56 and 58 in the indicia 60, information, relating to the brush to be held by the device, may be printed on the larger rectangular portion 20.

A brush 12, with the display and protecting device 10, secured thereon, may be displayed on a typical peg type display board by placing a peg in a hole 62 provided in the brush handle. If so displayed, the brush would be held in an inverted position with respect to that shown in FIG. 1. However, a second tab or smaller rectangular portion 64, with a hole 66 therein, as shown in FIGS. 1 through 4 and 6 could be provided on the second side 22 of the larger rectangular portion 20, near the first end 26. With a peg on a pegboard placed within the hole 66, the brush could be supported on a display rack in the position shown in FIG. 1.

While two embodiments of the invention are shown with respect to fastening the ends of the larger rectangular portion to each other, such that the larger rectangular portion encloses a portion of the bristles of the brush, other securing means could be employed. Further, to ensure that the arrowhead shaped tab or projection 34 remains in the rectangular slot 48, a piece of tape could be placed over the arrowhead so as to engage the larger rectangular portion 20 on each side of the slot 48. For instance, that piece of tape may bear the bar code used to identify the manufacturer and specific product.

Figure 4:
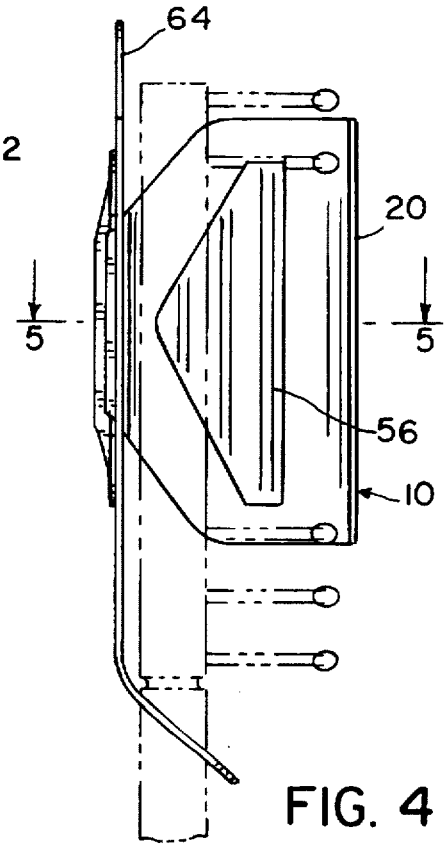
FIG. 4 is a side elevation view of the device of this invention as shown in FIG. 1.

As best seen in FIGS. 4 and 5, the larger rectangular portion 20 is wrapped around the bristle portion 16 of the brush so as to cover most of the elongated section of bristles. With the device 10 secured to the brush, the use of the brush in a person's hair is discouraged. However, enough of the bristles are exposed, as shown in FIG. 4, to provide a potential customer is opportunity to observe the bristles on the brush prior to purchase.

While two embodiments of the invention have been shown, it should be apparent to those skilled in the art that what has been described is considered at present to be the preferred embodiments of the device for use in displaying for sale, and protecting from use prior to sale, a hairbrush. In accordance with the patent statute, changes may be made in the device without actually departing from the true spirit and scope of this invention. The appended claims are intended to cover all such changes and modifications which fall in the true spirit and scope of this invention.

I claim:

1. A device for displaying a hairbrush for sale and preventing use of the hairbrush prior to sale, the hairbrush including a handle and a head having a plurality of bristles projecting from the head, the device comprising:

a strip of flexible sheet material having a predetermined length, first and second opposing sides extending along the length of the strip, and first and second opposing ends extending between said first and second sides, the first end secured to the second end to form a tube, the tube adapted to encircle the head of the hairbrush and at least a portion of the tube configured to be substantially perpendicular to the bristles; and a tab extending from the first side of the strip, the tab having an attached end coupled to the first side, a free end disposed opposite the attached end, and a hole formed therein, the hole configured to receive the handle of the hairbrush, wherein the free end of the tab extends away from the strip and remains detached from the strip when the tab is secured to the handle.

2. The device of claim 1, wherein the strip and the tab are integrally formed from the flexible sheet material.

3. The device of claim 1, wherein the tube is configured to cover only a middle region of the head of the hairbrush.

4. The device of claim 1, wherein the first and second ends are secured to one another with an adhesive.

5. The device of claim 1, wherein the first end includes a slot, and the second end includes a projection, the projection being received in the slot to secure the ends together.

6. The device of claim 1, further comprising a second tab extending from the second side, the second tab having a hole configured to support the hairbrush on a display rack.

7. A method for wrapping a hairbrush for display comprising the steps of:

providing a hairbrush having a longitudinal axis, the brush including a handle, a head extending along the longitudinal axis, and a plurality of bristles projecting from the head generally transverse to the longitudinal axis;

securing a wrapping strip around at least a portion of the head such that a portion of the strip is substantially perpendicular to the bristles of the hairbrush; and securing a tab to the handle to maintain the strip in place around the head, the tab having an attached end coupled to the wrapping strip, a free end disposed opposite the attached end, and a hole formed therein for receiving the handle, wherein the free end of the tab extends away from the strip and remains detached from the strip when the tab is secured to the handle.

8. The method of claim 7, wherein the strip and the tab are integrally formed from a single sheet of flexible material.

9. The method of claim 7, wherein the strip covers only a middle region of the head of the hairbrush.

10. The method of claim 7, wherein the strip has first and second mutually opposed ends, the first end secured to the second end with an adhesive.

11. The method of claim 7, wherein the first end includes a slot disposed therein, and the second portion includes a projection, the projection being received in the slot to secure the ends together.

12. The method of claim 7, wherein the strip includes a second tab having a hole for supporting the hairbrush on a display rack.

13. A system for displaying a hairbrush for sale and preventing use of the hairbrush prior to sale, the system comprising:

a hairbrush having a longitudinal axis and including a handle, a head extending along the longitudinal axis, and a plurality of bristles projecting from the head generally transverse to the longitudinal axis;

a strip of flexible sheet material having a predetermined length, first and second opposing sides extending along the length of the strip, and first and second opposing ends extending between said first and second sides, the first end secured to the second end to form a tube, the tube encircling the head of the hairbrush, at least a portion of the tube being substantially perpendicular to the bristles; and a tab extending from the first side of the strip, the tab having an attached end coupled to the first side, a free end disposed opposite the attached end, and a hole formed therein receiving the handle of the hairbrush, wherein the free end of the tab extends away from the strip and remains detached from the strip.

14. The system of claim 13, wherein the strip and the tab are integrally formed from the flexible sheet material.

15. The system of claim 13, wherein the tube covers only a middle region of the head of the hairbrush.

16. The system of claim 13, wherein the first and second ends are secured to one another with an adhesive.

17. The system of claim 13, wherein the first end includes a slot, and the second end includes a projection, the projection being received in the slot to secure the ends together.

18. The system of claim 13, further comprising a second tab extending from the second side of the strip, the second tab having a hole formed therein for supporting the hairbrush on a display rack.

* * * * *